United States Patent [19]

Stahlecker

[11] Patent Number: 4,972,668

[45] Date of Patent: Nov. 27, 1990

[54] ARRANGEMENT FOR THE INTERMEDIATE STORAGE OF A YARN AT A SPINNING MACHINE

[75] Inventor: Fritz Stahlecker, Bad Ueberkingen, Fed. Rep. of Germany

[73] Assignee: Hans Stahlecker, Fed. Rep. of Germany; a part interest

[21] Appl. No.: 398,429

[22] Filed: Aug. 25, 1989

[30] Foreign Application Priority Data

Aug. 27, 1988 [DE] Fed. Rep. of Germany ..... 3829151

[51] Int. Cl.[5] ..... D01H 15/00

[52] U.S. Cl. ..... 57/261; 57/22; 242/35.6 R

[58] Field of Search ..... 57/22, 261, 263; 242/35.6 R; 226/118, 97

[56] References Cited

U.S. PATENT DOCUMENTS

| | | | |
|---|---|---|---|
| 4,121,409 | 10/1978 | Uchida et al. | 57/22 |
| 4,125,989 | 11/1978 | Stahlecker et al. | 57/263 |
| 4,223,518 | 9/1980 | Karl et al. | 57/263 |
| 4,327,546 | 5/1982 | Derichs et al. | 57/263 |
| 4,356,692 | 11/1982 | Karl et al. | 57/263 |
| 4,598,539 | 7/1986 | Stahlecker et al. | 57/263 |

FOREIGN PATENT DOCUMENTS

| | | |
|---|---|---|
| 2221316 | 9/1973 | Fed. Rep. of Germany . |
| 2802913 | 11/1978 | Fed. Rep. of Germany . |
| 2728620 | 10/1984 | Fed. Rep. of Germany . |
| 59-186873 | 10/1984 | Japan . |

*Primary Examiner*—Joseph J. Hail, III

*Attorney, Agent, or Firm*—Evenson, Wands, Edwards, Lenahan & McKeown

[57] ABSTRACT

In an arrangement for the intermediate storing of a yarn at a spinning machine between a delivery device and a device which establishes a yarn connection during a piecing operation, a suction pipe is provided which stores the continuously supplied yarn in the form of a loop. The suction pipe is bent or curved in such a manner that it has supports for the yarn strands of the loop, these supports being separated from one another in axial direction with respect to the bending axis.

19 Claims, 4 Drawing Sheets

Fig. 3
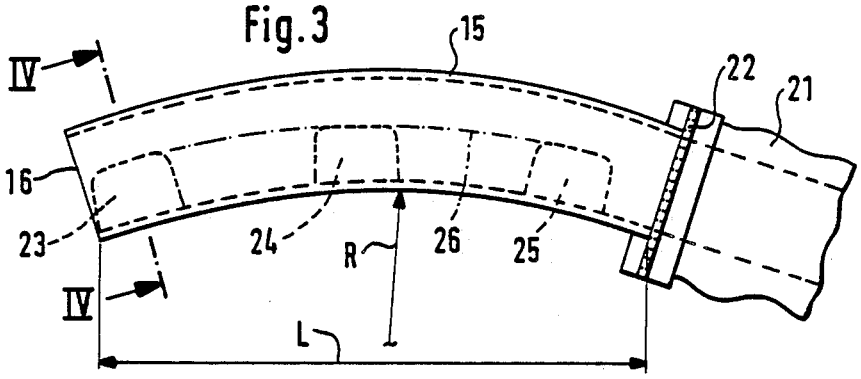
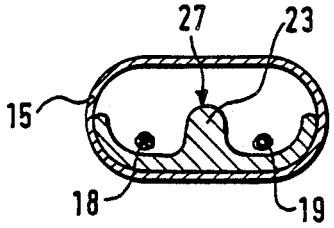
Fig. 4
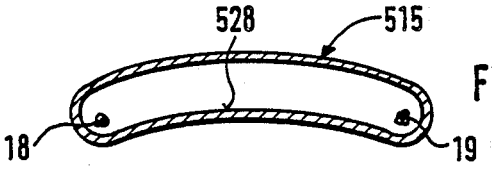
Fig. 5
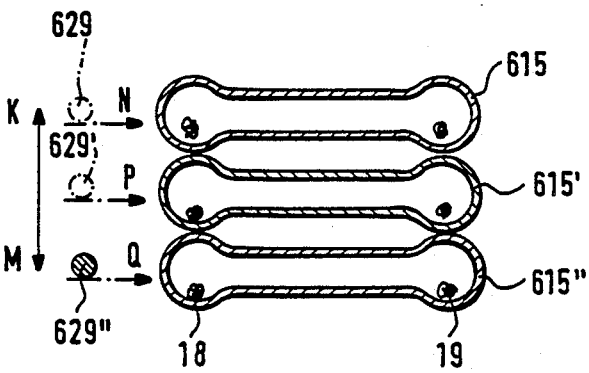
Fig. 6

ARRANGEMENT FOR THE INTERMEDIATE STORAGE OF A YARN AT A SPINNING MACHINE

BACKGROUND AND SUMMARY OF THE INVENTION

The invention relates to an arrangement for the intermediate storage of a yarn at a spinning machine between a delivery device and a device which establishes a yarn connection during a piecing and which contains a suction pipe taking in the yarn as a loop, this suction pipe being provided with a profiling for keeping the two yarn strands of the loop separate.

In a known arrangement of the initially mentioned type (DE-C-27 28 620), a suction pipe is provided which is equipped with a partition extending in its longitudinal direction which is fastened at one of the side walls of the suction pipe. As a result, the space of the suction pipe is divided into two parts, by means of which a balling up is to be prevented in the taken-in yarn. This suction pipe is to be used in connection with an air spinning machine and in connection with a knotting arrangement.

A suction pipe which is used as an intermediate storage device is also known (DE-B-28 02 913) and has a narrowing in its center so that the cross-section is divided into two partial areas, in which the two strands of the yarn loop are to be kept separate from one another.

It is also known (JP-A-59-186 873) to produce diminished cross-sections in a suction pipe by means of inserts. In this construction, it is also provided that the suction pipe forms a meandering intermediate storage device.

In the case of an open-end spinning arrangement, it is also known (DE-B 22 21 316) to take up, by means of a suction pipe, a yarn length which is generated during the piecing operation as a result of the fact that the newly pieced yarn is withdrawn faster than it is taken up by the spool package which requires a longer start-up time. In this construction, the suction pipe has a bend, by means of which the suction forces apply force components to the strands of the yarn loop by which the two yarn strands are moved toward one another.

An object of the invention is to provide an arrangement of the initially mentioned type which is also suitable for very high delivery speeds, i.e., which must take up longer yarn lengths than in the case of the state of the art.

This object is achieved in that the suction pipe is bent in such a manner that, it has supports which are separated from one another for the yarn strands in the axial direction parallel to the axis of the bend.

By means of this bend and support arrangement, it is achieved that the suction forces exercise components on the two yarn strands by means of which these are deposited at separate points at supporting surfaces formed by a wall or the like, so that is is ensured that even a yarn loop having a relatively long length does not twist around itself. In contrast, the yarn strands, as a result of the components of the suction air flows caused by the bend, place themselves against the corresponding support areas. The loop thus keeps a defined shape.

In a further development of certain preferred embodiments of the invention, it is provided that the radius of the bend of the suction pipe is larger than the length of the suction pipe. As a result, it is ensured that the occuring friction forces to not become too high.

In a further development of certain preferred embodiments of the invention, it is provided that the profiling is divided into several sections in longitudinal direction of the suction pipe. This is completely sufficient for still keeping the yarn strands separately in a perfect manner.

In a further development of certain preferred embodiments of the invention, it is provided that the suction pipe is constructed as a flat pipe which has a central contracted area between two larger lateral cross-sectional areas. This type of a pipe may be produced from a circular pipe.

In another development of certain preferred embodiments of the invention, it is provided that the suction pipe is constructed as a flat tube which is bent around its longitudinal axis. The convexly curved bottom, which preferably forms an area of a reference cylinder, is used as the separating element which keeps the two yarn strands apart. A diminished cross-section is not required inside the suction pipe.

In a further development of certain preferred embodiments of the invention, it is provided that several suction pipes are provided which consecutively take up yarn loops. In this development, the yarn length to be taken up is divided into several yarn loops which are each shorter than one single yarn loop taking up the same length, so that then the yarn loop can be held even better in this manner in that no tangling of the yarn or the like can occur.

Other ojects, advantages and novel features of the present invention will become apparent from the following detailed description of the invention when considered in conjunction with the accompanying drawings.

BRIEF DESCRIPTION OF THE DRAWINGS

FIG. 3 is a lateral view of a construction of a suction pipe according to a preferred embodiment of the invention;

FIG. 4 is a cross-sectional view of the suction pipe according to FIG. 3;

FIG. 5 is a cross-sectional view of another embodiment of a suction pipe;

FIG. 6 is a view of the arrangement of several successively used suction pipes constructed according to another embodiment of the invention.

DETAILED DESCRIPTION OF THE DRAWINGS

Figure 1:
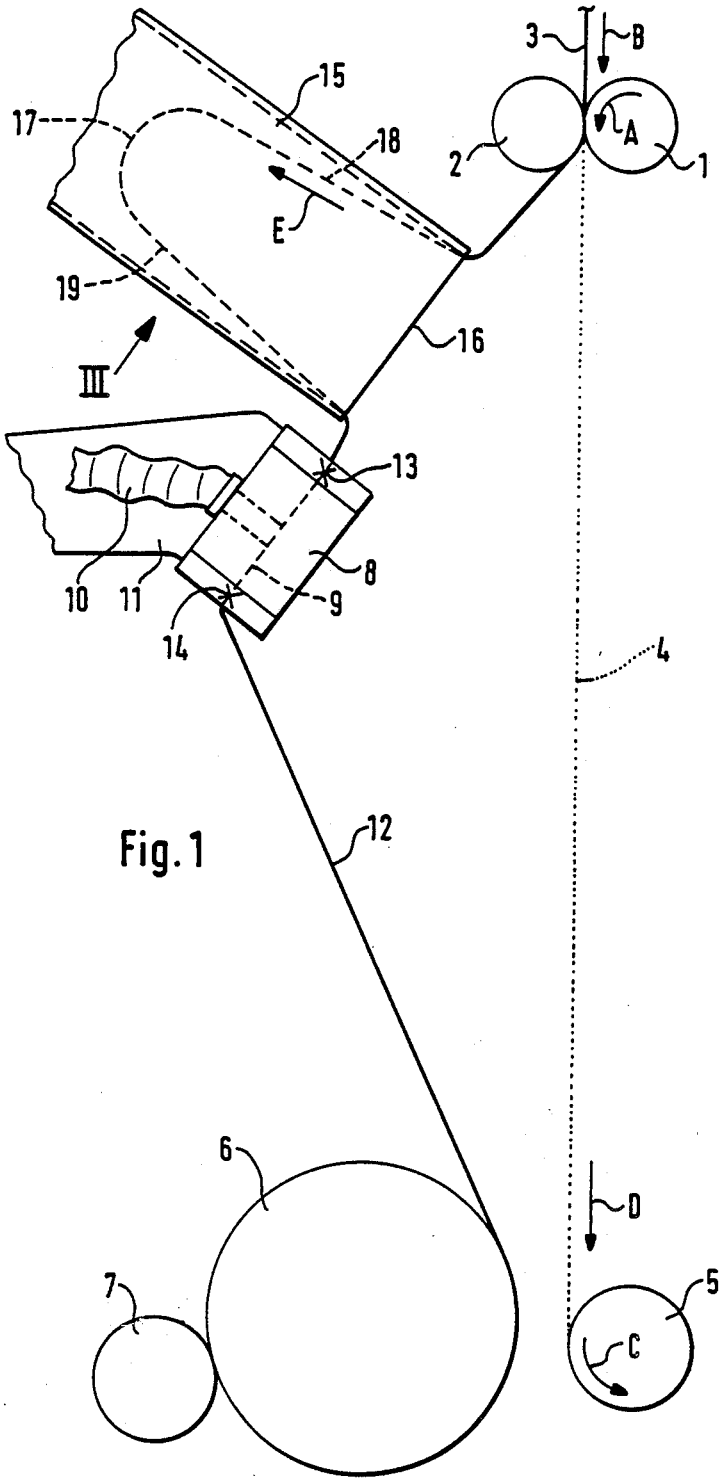
FIG. 1 is a schematic representation of an arrangement for an intermediate storage at a spinning machine during a piecing operation while the suction pipe is being filled, constructed according to a preferred embodiment of the invention.
Figure 2:
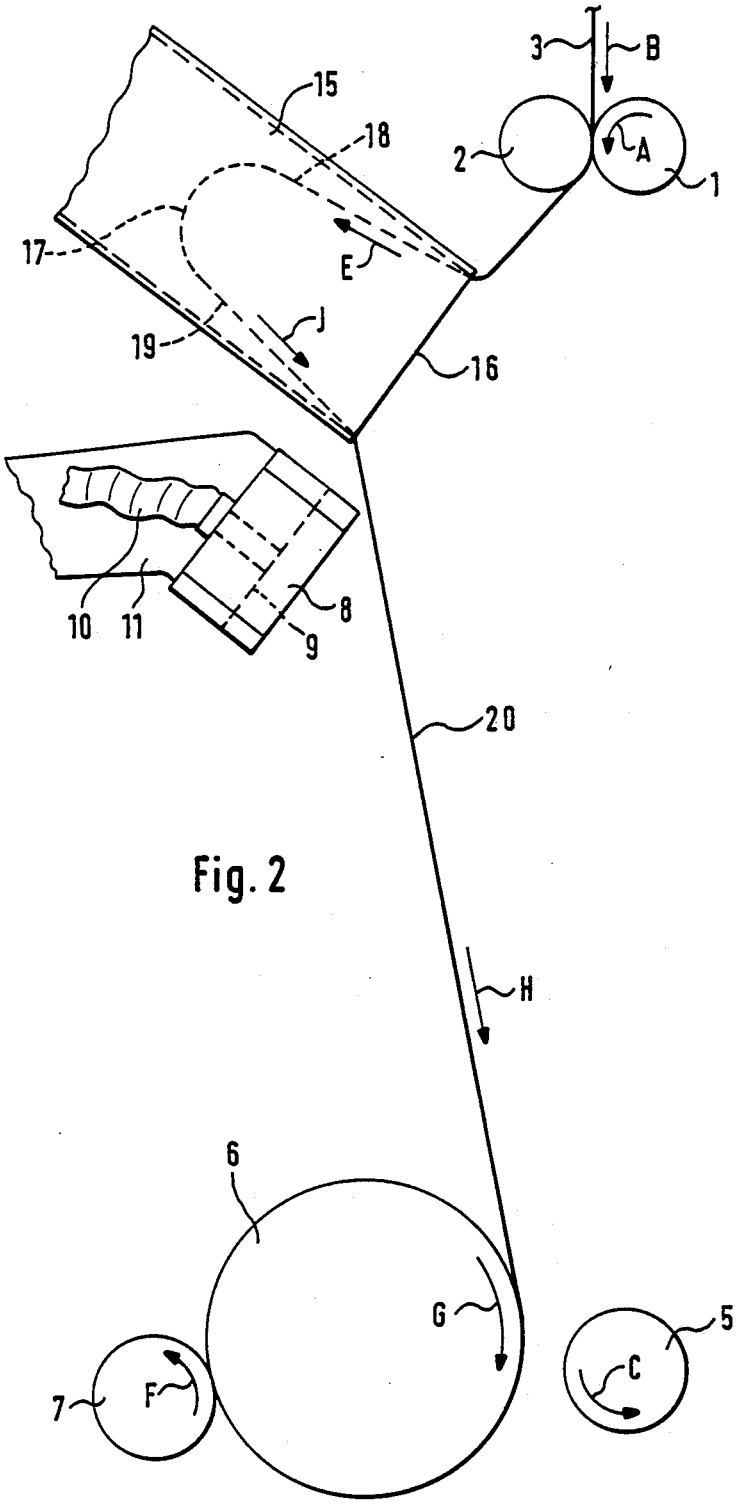
FIG. 2 is a schematic representation of the embodiment according to FIG. 1, shown at a slightly later point in time, in which the suction pipe is being emptied again.

FIGS. 1 and 2 schematically show only a part of a spinning unit of a spinning machine, specifically a pair of delivery rollers 1, 2 as well as a wind-up roller 5. The delivery roller pair 1, 2, which rotates in the direction of the arrow (A), withdraws a yarn 3 arriving in the direction of the arrow (B), which, in the normal operation, moves corresponding to the dotted line 4 in the direction of the arrow (D) and is wound by the wind-up roller 5 on a spool package 6 resting against it.

In case of a yarn breakage, the spool package 6 is lifted off the wind-up roller by devices which are not shown in detail and which are controlled by a yarn detector, as shown in FIG. 1. In this case, the spinning operation is also interrupted so that the yarn is fed to the delivery roller pair 1, 2.

The piecing operation is carried out by an automatic piecing arrangement which connects a newly spun yarn 3, which is delivered by the delivery roller pair 1, 2, with a yarn 12 withdrawn from a spool package 6. An auxiliary wind-up roller 7 of the automatic servicing apparatus is applied to the spool package 6 lifted off the wind-up roller. This auxiliary wind-up roller 7 can drive the spool package 6 in wind-off and wind-up direction. The yarn 12 which is taken up at the spool package 6 by a device which is not shown is placed in a splicing duct 9 of a splicing arrangement 8 of the servicing apparatus. The newly spun yarn 3 coming from the delivery roller pair 1, 2 is also placed in this splicing duct 9. The splicing arrangement 8, which is connected with a compressed-air supply line 10, is arranged on an arm 11. On both sides of the splicing duct 9, the splicing arrangement 8 is equipped with yarn clamps 13, 14 which are only outlined, by which the yarns 17 are held during the splicing operation.

Although the time period required for the splicing is relatively short, as a result of the high delivery speed, a relatively long length of newly spun yarn 3 is obtained which must be kept in intermediate storage during the splicing. In the case of an arrangement for pneumatic false-twist spinning, particularly if, in this case, two yarn components are prestrengthened only by means of twisting, which subsequently are twisted together, delivery speeds of 350 m/min. are obtained. In order to keep the yarn 3, which is supplied continuously during the splicing, in intermediate storage, a suction pipe 15, with its mouth 16, is assigned to the yarn path between the delivery rollers 1, 2 and the splicing arrangement 8 and takes in the continuously supplied yarn 3 as a yarn loop 17. While the entering yarn strand 18 moves into the suction pipe 15 in the direction of arrow (E), the yarn strand 19 is stopped at least in the area of the mouth, until the splicing operation is finished, the yarn clamps 13, 14 have opened up again and, by means of the driving of the auxiliary wind-up roller 7 in the direction of arrow (F), the spool package 6 is driven in wind-up direction (G), so that the newly pieced yarn 20 moves toward the spool package 6 in the direction of arrow (H). In this case, the yarn strand 19 is withdrawn from the suction pipe 15 in the direction of arrow I, while the yarn strand 18, at a lower speed, is still entering in the direction of arrow (E). The wind-up speed of the spool package 6, during this time, is significantly higher than the delivery speed of the delivery roller pair 1, 2, so that the suction pipe 15 is emptied as fast as possible. As soon as the yarn loop 17 has opened up, the wind-up speed of the spool package 6 is reduced and is brought to the normal operating speed. Subsequently, the spool package 6 is transferred to the wind-up roller 5 of the spinning unit so that the whole piecing operation is concluded.

In order to reliably avoid the occurrence of yarn curling or the like in the yarn loop 17 at very high delivery speeds of the newly pieced yarn 3, and also prevent that the yarn loop 17 twists around itself, the suction pipe 15 is bent in such a manner that, in axial direction to its bending axis (parallel to its bending axis), it forms separate support areas for the fiber strands 18, 19. As shown particularly in FIG. 3, which represents a view in the direction of the Arrow III of FIG. 1, the bending axis extends in parallel with respect to the yarn travel path direction past the area of the mouth 16 of the suction pipe 15, prior to deflection of the travel path by the suction pipe 15. The suction pipe, which is connected to a suction line 21 with the insertion of a sieve 22 exercises suction forces on the two yarn strands 18, 19 which load it with a component in radial direction to the bending axis and thus with a component which is directed essentially vertically with respect to the two support areas. The suction air currents do not affect the two yarn strands 18, 19 with force components which are directed toward one another. By means of the size of the bending radius (R) is relationship to the length (L) of the suction pipe 15, the thus occurring force components can be influenced by means of which the yarn strands 18, 19 are pulled to the support surfaces and thus the friction forces required for a withdrawing against the suction effect.

In the embodiment according to FIGS. 3 and 4, the suction pipe 15 is provided with a profiling 27 constructed as an insert and fastened in the suction pipe 15. Since it is sufficient for this profiling 27 to extend only over sections, it is provided in the shown embodiment that the profiling 27 is represented in threee sections 24, 25, 26. It is to be understood that the edges of section 24, 25, 26 are to be tapered and configured so as not to catch or snag the yarn loop as it is sucked into the pipe 15.

It is also contemplated in other embodiments, as indicated in FIG. 3 by means of a dash-dotted line 26, to provide a continuous insert. This profiling 27 subdivides the suction pipe 15 into two grooves which extend in parallel with respect to one another and have the same bending radius (R), a hump being provided between these grooves which maintains a distance to the exterior wall having a larger bending radius (R).

The profiling 27 corresponding to FIGS. 3 and 4 can also be implemented by means of a correspondingly shaped sheet-metal pipe or the like, without the requirement of providing an insert or the like.

A simplified embodiment of a suction pipe 515 is shown in FIG. 5. This suction pipe 515 which, corresponding to FIG. 3, is bent around an axis which is parallel to the yarn path in the area of the mouth, is in addition also bent around its longitudinal axis so that between the two edges areas, in which the yarn strands 18, 19 are guided, a curved bottom 528 exists which separates the two yarn strands 18, 19 from one another.

In the embodiment according to FIG. 6, several suction pipes 615, 615', 615''' are provided which each have two lateral areas with a slightly larger cross-section in which the yarn strands 18, 19 are guided. A slot-shaped connecting area exists between them. Also in this embodiment, guide grooves are obtained in the supporting areas, these guide grooves being bent with the same bending radius. A yarn guide 629 is assigned to the suction pipes 615, 615', 615'' which can be moved in the direction of the double arrow (K, M) into positions 629, 629', 629''. Thus this yarn guide 629 controls that suction pipe of suction pipes 615, 615', 615'' which is being filled. In position 629, the newly spun yarn 3 moves in the direction of the arrow (N) toward the suction pipe 615. In position 629', it moves in the direction of the arrow (P) to the suction pipe 615', and in position 629'', it moves in the direction of arrow Q to the suction pipe 615''. When the suction pipes are emptied, the yarn guide 629 will then move in the opposite direction, so that, for example, suction pipe 615'' is emptied first and suction pipe 615 is emptied last.

In the embodiment according to FIG. 7, two suction pipes 715, 715' are provided which, in a manner not shown in detail, can be moved relative to the yarn path (S) and which successively during the piecing take up yarn loops. In the individual figures, these suction pipes 715, 715' and a pertaining yarn guide 729 are shown in different positions which they take up before, during and after the piecing.

Figure 7A:
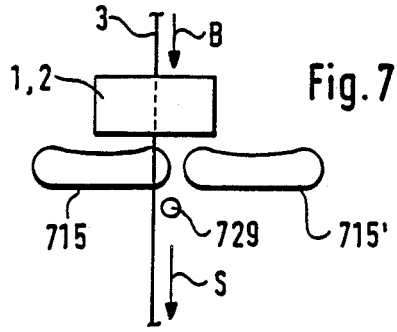
FIGS. 7A to 7D are schematic views of the intermediate storage of a yarn in an arrangement containing several suction pipes at different points in time of their operation.
Figure 7B:
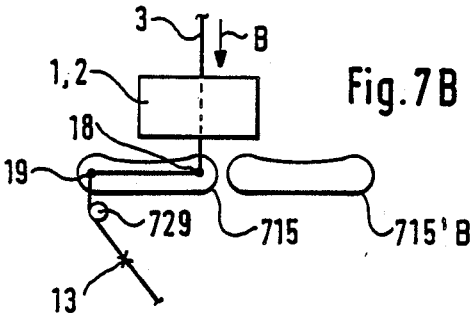
Figure 7C:
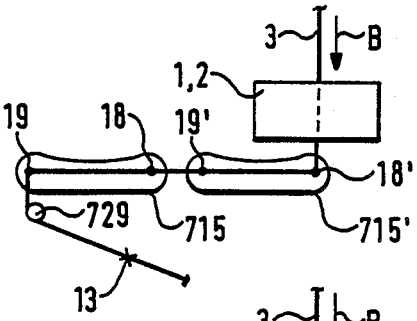

In FIG. 7A, the yarn 3, behind the delivery roller pair, continues to move in the direction (S) without being stored. A yarn suction pipe 715 of an intermediate storage device is already applied to the yarn 3, this intermediate storage device containing another suction pipe 715'. A yarn guide 729 is also located in proximity of the yarn 3. As soon as the yarn clamp 13 indicated in FIG. 7B is closed, the storage device is actuated, in that, no later than at this point in time, the yarn suction pipe 715 is subjected to suction and the yarn guide 729 is deflected transversely to the path of the yarn (FIG. 7B). With two yarn strands 18, 19, the yarn 3, as a yarn loop, then enters into the suction pipe 715 which is constructed corresponding to the embodiment according to FIG. 5. As soon as the suction pipe 715 is filled, the yarn guide 729 and the suction pipe 715 are moved along so that the suction pipe 715' takes up the position which the suction pipe 715 had previously. A yarn is now being formed in the suction pipe 715' with yarn strands 18', 19'.

Figure 7D:
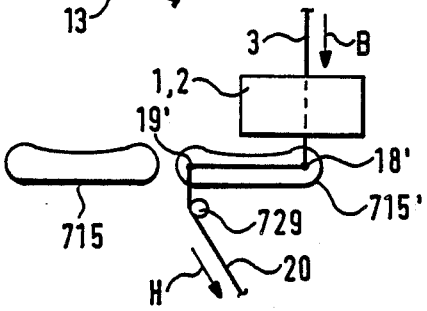

As soon as the spliced connection is established, the yarn clamps 13, 14 are lifted and the spool package 6 is driven in wind-up direction (FIG. 2). The pieced yarn 20 will then be withdrawn from the suction pipes 715, 715'. In FIG. 7D, it is shown that the suction pipe 715 is already empty, after which the yarn guide 729 has moved back into the area of the strand 19' of suction pipe 715'. As soon as the yarn loop is withdrawn from the suction pipe 715', the yarn guide 729 is moved back into the starting position (FIG. 7A). Then the arrangement, for the intermediate storage of the yarn 3, which is part of a movable servicing apparatus, can be moved out of the area of the respective spinning unit.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An arrangement for the intermediate storage of a yarn at a spinning machine between a delivery device and a piecing device which establishes a yarn connection during a piecing operation and which contains a suction pipe taking in the yarn as a loop, this suction pipe keeping the two yarn strands of the loop separate, wherein the suction pipe is bent in such a manner that is has separate supports for the yarn strands, said supports being spaced from one another in the axial direction of a bending axis of the suction pipe, said bending axis extending substantially parallel to a line between the delivery device and the piecing device.

2. An arrangement according to claim 1, wherein the radius (R) of the bend of the suction pipe is larger than the length (L) of the suction pipe.

3. An arrangement according to claim 2, wherein a profiling is provided in the suction pipe for keeping the two yarn strands of the loop separate, the profiling being divided into several sections in the longitudinal direction of the suction pipe.

4. An arrangement according to claim 2, wherein the suction pipe is constructed as a flat pipe which has a central contracted area between two lateral larger cross-sectional areas.

5. An arrangement according to claim 2, wherein a plurality of said suction pipes are provided which successively take up yarn loops.

6. An arrangement according to claim 5, wherein at least one yarn guiding element is provided for controlling the sequence of the filling of the suction pipes.

7. An arrangement according to claim 5, wherein a plurality of said suction pipes are provided which successively take up yarn loops.

8. An arrangement according to claim 1, wherein a profiling is provided in the suction pipe for keeping the two yarn strands of the loop separate, the profiling being divided into several sections in the longitudinal direction of the suction pipe.

9. An arrangement according to claim 8, wherein the suction pipe is provided with at least one insert forming the profiling.

10. An arrangement according to claim 8, wherein the suction pipe is constructed as a flat pipe which is curved about its longitudinal axis.

11. An arrangement according to claim 1, wherein the suction pipe is constructed as a flat pipe which has a central contracted area between two lateral larger cross-sectional areas.

12. An arrangement according to claim 11, wherein a plurality of said suction pipes are provided which successively take up yarn loops.

13. An arrangement according to claim 12, wherein at least one yarn guiding element is provided for controlling the sequence of the filling of the suction pipes.

14. An arrangement according to claim 12, wherein a plurality of said suction pipes are provided which successively take up yarn loops.

15. An arrangement according to claim 1, wherein the suction pipe is constructed as a flat pipe which is curved about its longitudinal axis.

16. An arrangement according to claim 1, wherein a plurality of said suction pipes are provided which successively take up yarn loops.

17. An arrangement according to claim 16, wherein at least one yarn guiding element is provided for controlling the sequence of the filling of the suction pipes.

18. An arrangement according to claim 16, wherein the suction pipes are held by means of devices which apply them, one after the other, to the yarn path.

19. An arrangement according to claim 1, wherein the suction pipe is bent starting from a portion thereof immediately adjacent its mouth which takes in the yarn as a loop.

* * * * *